US010305194B2

(12) United States Patent
Martel

(10) Patent No.: US 10,305,194 B2
(45) Date of Patent: May 28, 2019

(54) COMPACT, MULTIBAND AND OPTIONALLY RECONFIGURABLE HIGH-IMPEDANCE SURFACE DEVICE AND ASSOCIATED PROCESS

(71) Applicant: ONERA, Palaiseau (FR)

(72) Inventor: Cédric Martel, Pechabou (FR)

(73) Assignee: ONERA, Palaiseau (FR)

( * ) Notice: Subject to any disclaimer, the term of this patent is extended or adjusted under 35 U.S.C. 154(b) by 116 days.

(21) Appl. No.: 15/532,944

(22) PCT Filed: Nov. 26, 2015

(86) PCT No.: PCT/FR2015/053220
§ 371 (c)(1),
(2) Date: Jun. 2, 2017

(87) PCT Pub. No.: WO2016/087749
PCT Pub. Date: Jun. 9, 2016

(65) Prior Publication Data

US 2017/0365931 A1 Dec. 21, 2017

(30) Foreign Application Priority Data

Dec. 5, 2014 (FR) ..... 14 61962

(51) Int. Cl.
*H01Q 15/00* (2006.01)
*H01Q 1/52* (2006.01)
*H01Q 5/00* (2015.01)

(52) U.S. Cl.
CPC ..... *H01Q 15/0066* (2013.01); *H01Q 1/521* (2013.01); *H01Q 1/523* (2013.01);
(Continued)

(58) Field of Classification Search
CPC ..... H01Q 15/00–15/0066; H01Q 1/52–1/523; H01Q 5/00; H01Q 13/00–13/06
(Continued)

(56) References Cited

U.S. PATENT DOCUMENTS 4,042,935 A * 8/1977 Ajioka ..... H01Q 13/18 343/795
6,670,932 B1 12/2003 Diaz et al.
9,843,099 B2 * 12/2017 Legay ..... H01Q 1/405

OTHER PUBLICATIONS

International Search Report issued in PCT/FR2015/053220 dated Feb. 26, 2016 (with English translation).
(Continued)

*Primary Examiner* — Dameon E Levi
*Assistant Examiner* — Hasan Z Islam
(74) *Attorney, Agent, or Firm* — Kenealy Vaidya LLP

(57) ABSTRACT

Some embodiments are directed to a high impedance surface device. The high impedance surface device can include a set of at least two separate, substantially cylindrical compartments, that have internal surfaces in an electrically conductive material. The compartments each define, at one end, a single aperture, oriented on the same side, and covered by at least one periodic structure of electrically conductive patterns. Each compartment is filled with a dielectric material, and is thus covered forming at least one electromagnetic resonator. Each electromagnetic resonator exhibits a resonant wavelength. The at least two compartments are separated from one another by a distance less than the shortest resonant wavelength exhibited by the resonators that they form. At least two respective resonant wavelengths of the electromagnetic resonators formed by the at least two covered compartments are different, and the periodic structure exhibits a spatial period less than half the shortest resonant wavelength.

14 Claims, 2 Drawing Sheets

(52) U.S. Cl.
CPC ..... *H01Q 5/00* (2013.01); *H01Q 15/004* (2013.01); *H01Q 15/006* (2013.01); *H01Q 15/0086* (2013.01)

(58) Field of Classification Search
USPC ..... 343/700 MS, 846, 909
See application file for complete search history.

(56) References Cited

OTHER PUBLICATIONS

Written Opinion issued in PCT/FR2015/053220 dated Feb. 26, 2016.
Dan Sievenpiper et al., "High-Impedance Electromagnetic Surfaces with a Forbidden Frequency Band", IEEE Transactions on Microwave Theory and Techniques, IEEE Service Center, vol. 47, No. 11, Nov. 1, 1999, p. 2059.

* cited by examiner

COMPACT, MULTIBAND AND OPTIONALLY RECONFIGURABLE HIGH-IMPEDANCE SURFACE DEVICE AND ASSOCIATED PROCESS

CROSS REFERENCE TO RELATED APPLICATION

This application is a National Phase filing under 35 C.F.R. § 371 of and claims priority to PCT Patent Application No.: PCT/FR2015/053220, filed on Nov. 26, 2015, which claims the priority benefit under 35 U.S.C. § 119 of French Application No.: 1461962, filed on Dec. 5, 2014, the contents of which are hereby incorporated in their entireties by reference.

BACKGROUND

Some embodiments are directed to high-electromagnetic-impedance surface (or HIS, for "High Impedance Surface") devices.

In some fields, like that of satellite positioning signal receivers for example, surface devices with high electromagnetic impedance are used. The latter can, for example, be used to reduce the electromagnetic couplings between elements in multistandard adaptive networks.

It is recalled that a surface device with high electromagnetic impedance generally comprises a ground plane, at least one dielectric cavity (generally in the form of a substrate), and a printed circuit board (PCB), which is single-layer or multilayer, and comprising a multitude of conductive elements defining patterns arranged periodically and of small size and periodicity compared to the wavelength used.

When there is a desire for the surface device with high electromagnetic impedance to exhibit at least two resonant frequencies, it is possible, for example, to arrange it as described in the patent document U.S. Pat. No. 6,670,932. More specifically, this surface device with high electromagnetic impedance is of mushroom type, that is to say that it comprises a conductive ground plane defining a non-compartmentalized cavity but comprising a matrix of identical conductive pillars, filled with a dielectric material and covered by a printed circuit board bearing metallic patterns, in order to form electromagnetic resonators exhibiting different resonant wavelengths. The size and the periodicity of the elements (or "patches") defining the patterns is smaller than the resonant wavelengths of the electromagnetic resonators.

Each pattern is intended to capture, at the input of the cavity, an incident electromagnetic wave which is propagated in the ground plane, then to generate, under the pattern, an electric current loop at a determined resonant frequency so as to reflect any incident electromagnetic wave having a frequency in a narrow band centered around this resonant frequency.

The device described offers an interleaving of a first "matrix" of electromagnetic resonators that are identical and that have a first resonant frequency, with a second "matrix" of electromagnetic resonators that are identical and that have a second resonant frequency. This interleaving is obtained by the patterns which are borne by the printed circuit board of fractal or multilayer type, each pattern being centered either on a pillar or between four adjacent pillars.

SUMMARY

A drawback with this type of device lies in the fact that the first and second resonant frequencies cannot be adjusted independently of one another and that the reflection bands, of which these resonant frequencies are the center frequencies, are fairly narrow. Furthermore, this type of device proves relatively bulky.

Some embodiments are directed to improve or enhance the situation, and more specifically to make it possible to obtain, in a reduced space, resonant frequencies (or wavelengths) that can be adjusted easily relative to one another and defining the center frequencies (or wavelengths) of reflection bands spectrally wider than in the prior art.

To this end, it notably proposes a high-impedance surface device comprising a set of at least two separate compartments, which are substantially cylindrical, having internal surfaces in an electrically conductive material, and each having, at one end, a single aperture, these apertures of the compartments being oriented on one and the same side and covered by at least one periodic structure of electrically conductive patterns, each compartment being filled with a dielectric material, each compartment thus covered forming at least one electromagnetic resonator, and each electromagnetic resonator exhibiting a resonant wavelength.

In this device:

- the compartments are separated from one another by a distance which is less than the shortest resonant wavelength exhibited by the resonators that they form,
- at least two respective resonant wavelengths of the electromagnetic resonators, formed by its covered compartments, are different, and
- the periodic structure exhibits a spatial period less than half the shortest resonant wavelength.

The device according to some of embodiments can include other features which can be taken separately or in combination, and in particular:

- in a first embodiment, it can comprise a cavity within which each compartment is arranged, at least one vertical partition being arranged in this cavity, this vertical partition being electrically conductive and in contact with a bottom wall of the cavity and delimiting compartments, and a single periodic structure of electrically conductive patterns covering all the apertures of the compartments;
  - each vertical partition can be mobile in a direction which is substantially parallel to a plane defined by the bottom wall of the cavity;
  - each compartment can be provided with an auxiliary electrically conductive bottom wall, distinct from the bottom wall of the cavity and mounted to be vertically mobile in the cavity;
  - it can also comprise setting means arranged to set the height of each vertical partition;
  - one of the ends of each vertical partition, which extends facing one of the electrically conductive patterns, can have a flared section;
- in a second embodiment, it can comprise at least two unconnected cavities, each cavity forming one of the compartments;
  - it can comprise at least two horizontal partitions, each horizontal partition being electrically conductive and mounted to be vertically mobile inside one of the cavities, and forming a bottom wall of one of the compartments;
- each compartment can be covered by a single electrically conductive pattern;
- each periodic structure of electrically conductive patterns can be secured to support means;
  - it can comprise first setting means arranged to set the dielectric permittivity of the support means;

it can comprise second setting means arranged to set the magnetic permeability of the dielectric material.

Some embodiments are also directed to a satellite positioning signal receiver, comprising an electric ground plane, at least two radiant elements arranged on this ground plane, and at least one high-impedance surface device of the type of that presented above, arranged on the ground plane between the radiant elements.

Some embodiments are also directed to a method, intended to allow the modification of the impedance over several frequency bands of a high-impedance surface device, and comprising at least one step of modifying electromagnetic properties of at least one compartment of a high-impedance surface device of the type of that presented above.

Some embodiments are also directed to a method, intended to allow the fabrication of a high-impedance surface device which comprises several separate components, which are substantially cylindrical, and a periodic structure of electrically conductive patterns.

This method includes the following steps:

several substantially planar partitions are placed in a cavity, the cavity having at least one lateral wall and one bottom wall that are electrically conductive, each partition being electrically conductive and being in contact with the bottom wall; each partition defining a plane substantially at right angles to a plane defined by the bottom wall, the partitions delimiting the compartments, the compartments each having, at one end, a single aperture, these apertures of the compartments being oriented on one and the same side, the height of the cavity is adjusted so as to obtain a first desired resonant wavelength, associated with a first compartment, the first compartment being delimited by the lateral wall of the cavity and a first partition, inside the cavity, the position of each partition distinct from the first partition is adjusted relative to the latter and/or the height of each partition distinct from the first partition is adjusted, in order to obtain desired resonant wavelengths, associated with the compartments distinct from the first compartment, at least one of these desired resonant wavelengths being distinct from the first resonant wavelength, each compartment being arranged such that the distance which separates it from an immediately adjacent compartment is less than the shortest resonant wavelength out of the set of the desired resonant wavelengths, each compartment is filled with a dielectric material, and the periodic structure is placed over the cavity in order to cover the aperture of each compartment, each compartment thus covered forming an electromagnetic resonator exhibiting a resonant wavelength; the spatial period of the periodic structure being less than half of the shortest resonant wavelength.

BRIEF DESCRIPTION OF THE FIGURES

Other features and advantages of the invention will become apparent on examining the following detailed description, and the attached drawings, in which FIGS. 1 to 6 schematically and functionally illustrate, in cross-sectional views, six exemplary satellite positioning signal receivers equipped with different exemplary embodiments of a high-impedance surface device according to the invention.

DETAILED DESCRIPTION OF AN EXEMPLARY EMBODIMENT

Figure 1:
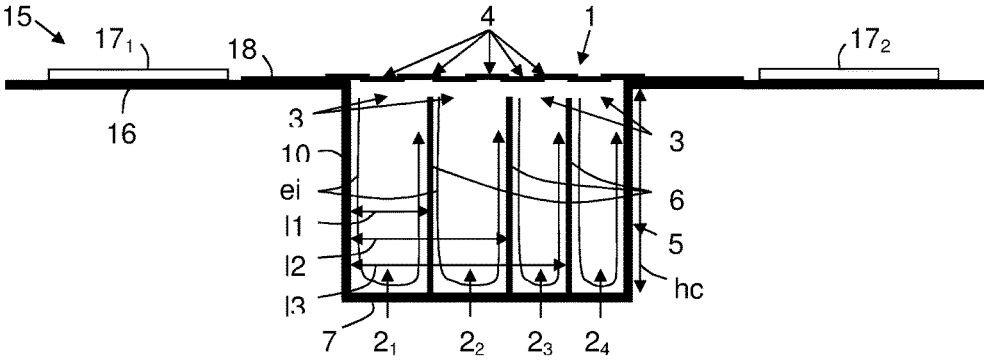

Some embodiments are directed to a compact, multiband and optionally reconfigurable high-impedance surface device 1, and associated methods.

Hereinbelow, it is considered, by way of nonlimiting example, that the high-impedance surface device 1 forms part of a satellite positioning signal receiver 15, possibly of GNSS (Global Navigation Satellite System) type. However, the invention is not limited to this application. A high-impedance surface device 1, according to the invention, can in fact be used to equip numerous appliances, systems or installations, in civilian or military fields, and notably land, sea, river or air vehicles, transmitting and/or receiving stations, and buildings (possibly of industrial type).

FIGS. 1 to 6 schematically represent a nonlimiting exemplary embodiment of a satellite positioning signal receiver 15, equipped with six different exemplary embodiments of a high-impedance surface device 1 according to the invention.

As illustrated, this receiver 15 comprises an electric ground plane 16, at least two radiant elements $\mathbf{17}_k$ arranged on this ground plane 16, and at least one high-impedance surface device 1 according to the invention, arranged on the ground plane 16 between the radiant elements $\mathbf{17}_k$.

For example, the radiant elements $\mathbf{17}_k$ define an adaptive network specifically for receiving navigation signals, for example GNSS signals, in a scrambled environment by modifying the radiation pattern of the receiver in order to generate radiation nulls (or zeros) in the directions of the scrambling interferences. The adaptation of the radiation pattern according to the scramblers is produced through a post-processing of the navigation signals received on each of the radiant elements $\mathbf{17}_k$ of the network.

It will be noted that, in the nonlimiting example illustrated in FIGS. 1 to 6, the receiver 15 comprises two radiant elements $\mathbf{17}_k$ (k=1 or 2). However, the receiver 15 can comprise any number of radiant elements $\mathbf{17}_k$, provided that this number is greater than or equal to two. In effect, the high-impedance surface device 1 can notably make it possible to reduce the electromagnetic couplings between radiant elements $\mathbf{17}_k$ and to optimize the robustness of the receiver 15 with respect to the electromagnetic interferences.

It is recalled that in an adaptive network, the electromagnetic couplings between radiant elements significantly degrade the performance levels, and in particular the capacity of the signal processing algorithms to accurately locate the angular position of the interferences and consequently to generate radiation nulls in their directions. In such a context, a high-impedance surface device 1 can be charged with stopping the currents which propagate between the radiant elements $\mathbf{17}_k$ of the adaptive network in order to reduce the electromagnetic couplings between radiant elements and to optimize the robustness of the GNSS receiver with respect to the electromagnetic interferences.

As illustrated in a nonlimiting manner in FIGS. 1 to 6, a high-impedance surface device 1, according to the invention, comprises at least one set of at least two compartments $\mathbf{2}_j$ and at least one periodic structure of electrically conductive patterns 4.

The compartments $\mathbf{2}_j$ of the set are separate and substantially cylindrical, have internal surfaces produced in an electrically conductive material, and each have, at one end, a single aperture 3. Furthermore, each compartment $\mathbf{2}_j$ is filled with a dielectric material, for example air. For example, the compartments $2_j$ are substantially cylindrical of rectangular or square section.

The apertures 3 of the compartments $2_j$ are all oriented on one and the same side and covered by at least one periodic structure of electrically conductive patterns 4. It will be understood that each aperture 3 can be associated with its own periodic structure of electrically conductive patterns 4, as illustrated in a nonlimiting manner in FIGS. 5 and 6, or else the apertures 3 can be associated with one and the same periodic structure of electrically conductive patterns 4, as illustrated in a nonlimiting manner in FIGS. 1 to 4.

It will be noted that each compartment $2_j$ can be covered by a single electrically conductive pattern 4.

It will also be noted that the electrically conductive patterns 4 of each periodic structure can be secured to support means, such as, for example, a printed circuit board (or PCB) 18, of single-layer or multilayer type. For example, the electrically conductive patterns 4 can be printed on this printed circuit board 18. The electrically conductive patterns are arranged periodically and their size and periodicity are small compared to the wavelength used.

In a variant that is not represented, each pattern 4 can be a metal grid ensuring its own support function.

It will also be noted that active elements, such as, for example, varactors, can optionally and beforehand be incorporated on/in the printed circuit board 18 to adjust the capacitive effect of the patterns 4.

It will also be noted that the device 1 can optionally comprise first setting means arranged to set the dielectric permittivity of the support means. The first setting means can be produced in the form of materials whose properties can be electronically controlled, such as for example liquid crystals, plasmas or else ferroelectric materials, and electronic control means for such materials. In a variant, the first setting means can be produced in the form of a metamaterial of adjustable permittivity. The dielectric permittivity acts on the inductance of the compartment $2_j$. The greater the permittivity, the lower the height of the compartment $2_j$ can be.

Each compartment $2_j$ forms, with the periodic structure of electrically conductive patterns 4 which covers its aperture 3, at least one electromagnetic resonator exhibiting a resonant frequency.

It will also be noted that the wider the compartment $2_j$, the greater the size of the internal current loop, and therefore the greater the inductance.

The compartments $2_j$ are separated from one another by a distance which is less than the shortest resonant wavelength exhibited by the electromagnetic resonators that they form. Moreover, at least two respective resonant wavelengths of the electromagnetic resonators formed by the covered compartments $2_j$ are different. Furthermore, the periodic structure of electrically conductive patterns 4 exhibits a spatial period which is less than half the shortest resonant wavelength.

The device 1 produces a high-impedance effect at several resonant frequencies (or wavelengths). The number of resonant frequencies (or wavelengths) that can be used is equal to the number of compartments. The high-impedance effect is produced on a hypothetical surface which is situated above the printed circuit board 18, very close and parallel to the printed circuit board 18 and being able to cover a greater or lesser surface depending on the resonant frequency (or wavelength) considered.

The device 1 can be produced according to exemplary embodiments which can be grouped together in at least two families. A first family combines the examples illustrated in FIGS. 1 to 4. A second family combines the examples illustrated in FIGS. 5 and 6.

For all the examples of the first family, the device 1 comprises a signal cavity 5 within which each compartment $2_j$ is arranged (or defined). To do this, the cavity 5 comprises at least one vertical partition 6 which is electrically conductive and in contact with a bottom wall 7 and which delimits two compartments $2_j$. Each vertical partition 6 is preferably substantially planar, and defines a plane substantially at right angles to a plane defined by the bottom wall 7 of the cavity 5. This electrically conductive nature can originate from the material in which the vertical partition 6 is produced or from the fact that the vertical partition 6 is coated on its surfaces with a layer of an electrically conductive material. Moreover, a single periodic structure of electrically conductive patterns 4 covers all the apertures 3 of the different compartments $2_j$.

The cavity 5 is delimited by at least one lateral wall 10 and the bottom wall 7. The latter walls 7, 10 are electrically conductive. This electrically conductive nature can originate from the material in which they are produced or from the fact that they are coated with a layer of an electrically conductive material on their internal surfaces.

It will be noted that the cavity 5 can either be added and secured to the ground plane 16, for example by soldering or bonding, or form an integral part of the ground plane 16, for example by stamping and cutting.

Figure 2:
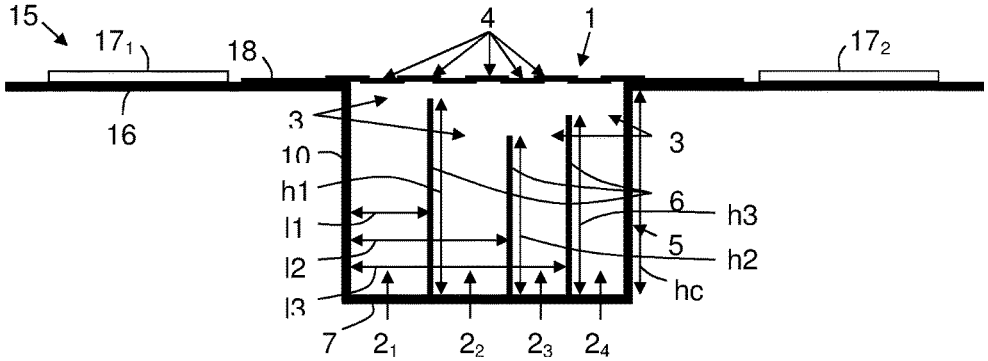
Figure 4:
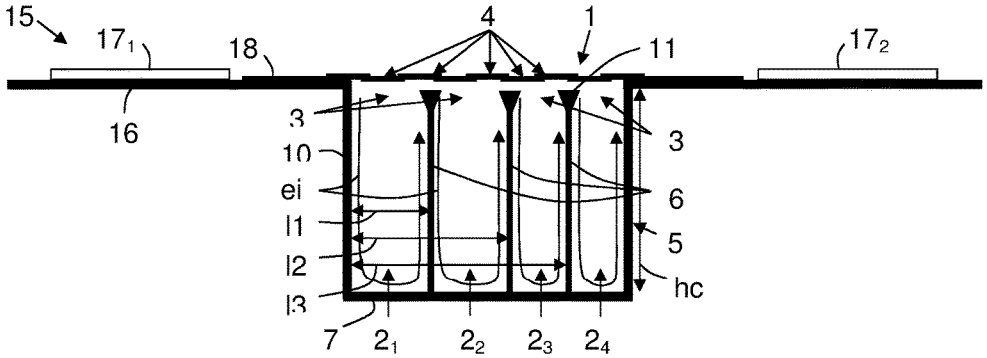

In the nonlimiting examples illustrated in FIGS. 1, 2 and 4, the cavity 5 comprises four compartments $2_1$ to $2_4$ (j=1 to 4), separated from one another by three vertical partitions 6.

Figure 3:
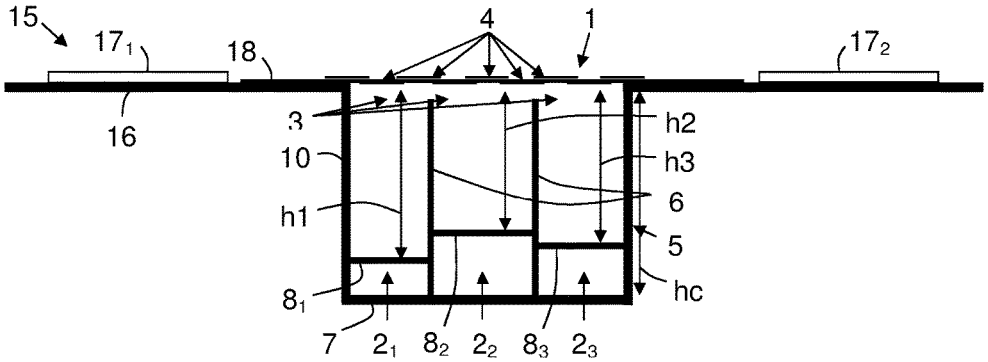

In the nonlimiting example illustrated in FIG. 3, the cavity 5 comprises three compartments $2_1$ to $2_3$ (j=1 to 3) separated from one another by two vertical partitions 6.

It will be noted that the cavity 5 can comprise any number of compartments $2_j$, provided that this number is greater than or equal to two.

This cavity 5 with multiple electromagnetic resonators produces capacitive and inductive effects ei which are the source of the high surface impedance. There is in particular a capacitive effect between the ground plane 16 and each pattern 4 which overlaps it, a capacitive effect between patterns 4 which overlap, and an inductive effect ei in each compartment $2_j$, more specifically in the depth hj of each compartment $2_j$, thus forming a current loop.

The presence of conductive vertical partition(s) 6 also induces additional capacitive and inductive effects. In particular, additional capacitive effects are present between the "top" ends 11 of the vertical partitions 6 and the patterns 4 which overlap them. These additional capacitive effects are particularly great given that the distances which separate them are small. Additional inductive effects are produced by the multiple current loops which are present in the different compartments $2_j$.

In this first family, for the first resonant frequency f1 associated with the first compartment $2_1$, the high-impedance effect is located in the zone which extends over all the cavity 5, whereas, for the other resonant frequencies f2, f3, . . . , fn, associated respectively with the other compartments $2_2$, $2_3$, . . . , $2_n$, the high-impedance effect is located either over all the cavity 5, or in a more restricted zone like above a compartment $2_j$ (j=2 to n), depending on the respective horizontal positions of the vertical partitions 6.

The value of the resonant frequencies depends on the capacitive and inductive effects obtained in the device 1. Consequently, the choice of the resonant frequencies can notably be made by adjusting the respective distances lm (here m=1 to 3 or 1 to 2) which separate the vertical partitions 6 from the lateral wall 10 and/or the respective heights hm of the vertical partitions 6, in other words the vertical distances between the top ends 11 of the vertical partitions 6 and the patterns 4 which overlap them. The vertical distances between the top ends 11 of the vertical partitions 6 and the patterns 4 can be null, the vertical partitions 6 being in this case in contact with the printed circuit board 18.

It will be noted that the resonant frequencies can be set by adjusting both the distances lm and the heights hm. This solution is notably advantageous when the aim is to obtain more than two resonant frequencies because it makes it possible to increase the degrees of freedom to optimize the device 1.

The choice of the resonant frequencies by adjustment of the respective distances lm separating the vertical partitions 6 from the lateral wall 10 is illustrated in FIGS. 1, 2 and 4. The choice of the resonant frequencies by adjustment of the respective heights hm of the vertical partitions 6 is illustrated in FIG. 2.

The choice of the resonant frequencies can be the subject either of an initial design or of a prior setting, for example via appropriate setting means for given functions, or of a setting in real time by means of appropriate setting means.

To allow a setting of the distances lm and therefore of the horizontal positions of the vertical partitions 6, each vertical partition 6 can be mobile in a direction which is substantially parallel to a plane defined by the bottom wall 7 of the cavity 5. In this case, the device 1 can comprise setting means arranged to set the horizontal position of each vertical partition 6 in the cavity 5.

To allow a setting of the heights hm, each vertical partition 6 can be mobile in a direction (here vertical) which is substantially at right angles to the plane defined by the bottom wall 7 of the cavity 5. In this case, the device 1 can comprise setting means arranged to set the height of each vertical partition 6 in the cavity 5.

In a variant, and as illustrated in FIG. 3, each compartment $\mathbf{2}_j$ can be provided with an auxiliary bottom wall 8, distinct from the bottom wall 7 of the cavity 5 that is electrically conductive and mounted to be vertically mobile in the cavity 5. It will be understood that by varying the position (here vertical) hm of an auxiliary bottom wall 8 of a compartment $\mathbf{2}_j$, that is tantamount to varying the height in the cavity 5 of the corresponding vertical partition 6. In this case, the device 1 can comprise setting means arranged to set the position (here vertical) of each auxiliary bottom wall 8 within its compartment $\mathbf{2}_j$.

It will be noted, as illustrated in a nonlimiting manner in FIG. 4, that the end 11 of each vertical partition 6 which extends facing one of the electrically conductive patterns 4 can possibly have a flared section. This in fact makes it possible to increase the capacitive effect between the vertical partition 6 and the patterns 4 of the printed circuit board 18.

By way of example, to set the resonant frequencies on the desired bands, the following method can be implemented. First of all, a first single-band electromagnetic resonator can be designed on a frequency f1. Then, the number of vertical partitions 6 can be determined to set the number of resonant frequencies f1 to fn. Then, the vertical partitions 6 can be inserted into the cavity 5. The height of the cavity 5 can then be adjusted to obtain the first resonant frequency at the frequency f1. Finally, the distances lm and/or the heights hm can be adjusted to set the frequencies f2 to fn of the other resonant frequencies.

In other words, a method is proposed that is intended to allow the modification of the impedance over several frequency bands of a device 1, and comprising at least one step of modifying electromagnetic properties of at least one compartment $\mathbf{2}_j$ of this device 1.

In a variant, a method can be intended to allow the fabrication of a high-impedance surface device 1 which comprises several separate compartments $\mathbf{2}_j$, which are substantially cylindrical, and a periodic structure of electrically conductive patterns 4.

This variant method comprises the following steps:

- several substantially planar partitions 6 are placed in a cavity 5, the cavity 5 having at least one lateral wall 10 and one bottom wall 7 that are electrically conductive, each partition 6 being electrically conductive and being in contact with the bottom wall 7; each partition 6 defining a plane substantially at right angles to a plane defined by the bottom wall 7, the partitions 6 delimiting the compartments $\mathbf{2}_j$, the compartments $\mathbf{2}_j$ each having, at one end, a single aperture 3, these apertures 3 of the compartments 2 being oriented on one and the same side,
- the height hc of the cavity 5 is adjusted in order to obtain a first desired resonant wavelength, associated with a first compartment $\mathbf{2}_1$, the first compartment $\mathbf{2}_1$ being delimited by the lateral wall 10 of the cavity 5 and a first partition 6,
- inside the cavity 5, the position of each partition 6 distinct from the first partition is adjusted relative to the latter and/or the height of each partition 6 distinct from the first partition is adjusted in order to obtain desired resonant wavelengths, associated with the compartments $\mathbf{2}_j$ distinct from the first compartment $\mathbf{2}_1$, at least one of these desired resonant wavelengths being distinct from the first resonant wavelength, each compartment $\mathbf{2}_j$ being arranged such that the distance which separates it from an immediately adjacent compartment $\mathbf{2}_j$ is less than the shortest resonant wavelength among the set of the desired resonant wavelengths,
- each compartment 2. is filled with a dielectric material, and
- the periodic structure is placed over the cavity 5 in order to cover the aperture 3 of each compartment $\mathbf{2}_j$, each compartment thus covered forming an electromagnetic resonator exhibiting a resonant wavelength; the spatial period of the periodic structure being less than half the shortest resonant wavelength.

It will be noted, surprisingly, that the variation of the width of the first compartment $\mathbf{2}_1$, and therefore the variation of the distance l1, hardly varies the first resonant frequency f1 but varies the second resonant frequency f2.

A modal analysis makes it possible to understand the unexpected effect resulting from the invention. In effect, the resonant frequency f1 remains stable as a function of the distance l1 because the mode generated in the device 1 is derived from a resonance in which the magnetic field moves vertically in the cavity 5 in phase balance. This resonant mode is that which is observed when the first vertical partition 6 is not present in the cavity 5 (case where l1=0). Through the nature of this resonant mode, the variation of the distance l1 does not in any way affect the resonant frequency f1. Conversely, the magnetic field in the device 1 at the resonant frequency f2 has a different mapping. The vertical partition 6 in effect interacts with the electromagnetic field, and therefore the field is cancelled on a vertical line in the vicinity of the vertical partition 6 and produces a mode of higher order than that observed at the resonant frequency f1. The distance l1 therefore conditions this resonant mode and affects the value of the resonant frequency f2.

For all the examples of the second family, the device 1 comprises at least two unconnected cavities $\mathbf{5}_j$ each forming (or defining) one of the compartments $\mathbf{2}_j$. The number of resonant frequencies (or wavelengths) is therefore here defined by the number of cavities $\mathbf{5}_j$.

Figure 5:
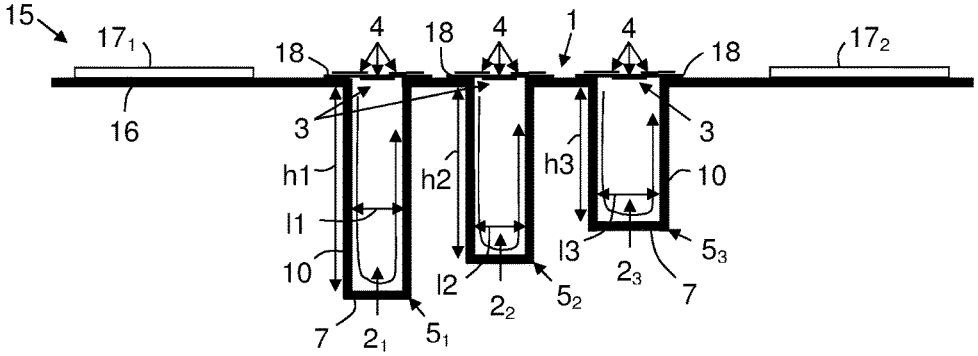
Figure 6:
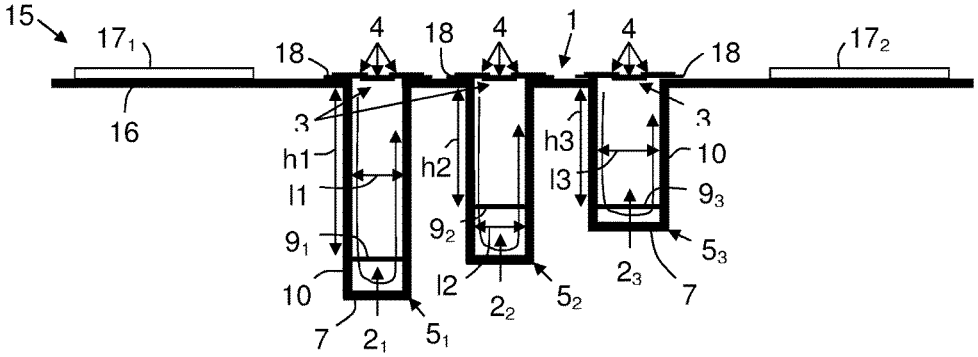

In the examples illustrated in a nonlimiting manner in FIGS. 5 and 6, each cavity $\mathbf{5}_j$ is associated with its own periodic structure of electrically conductive patterns 4 which is defined on its own printed circuit board 18. However, in a variant embodiment that is not illustrated, each cavity $\mathbf{5}_j$ is associated with its own periodic structure of electrically conductive patterns 4, but the different periodic structures are defined on one and the same printed circuit board 18.

The cavities $\mathbf{5}_j$, and therefore the electromagnetic resonators, share one and the same ground plane 16 and, as indicated above, are spaced apart from one another by a distance which is less than the shortest resonant wavelength.

This family of exemplary embodiments has the particular feature of producing successive high-impedance effects for distinct resonant frequencies. Each electromagnetic resonator is characterized by its own resonant frequency. The high-impedance effect is produced on a hypothetical surface located above the or each printed circuit board 18 and very close, and parallel, to the or each printed circuit board 18.

For each electromagnetic resonator, the resonant frequency depends primarily on the height hm (here m=j) of the associated cavity $\mathbf{5}_j$, on the dielectric material filling this cavity $\mathbf{5}_j$, and on the transmission and reflection characteristics of the printed circuit board 18. In effect, in a representation of "LC circuit" type, the height hm of a cavity $\mathbf{5}_j$ and the type of dielectric material in the cavity $\mathbf{5}_j$ directly impact the inductance value, whereas the printed circuit board 18 has a tendency to impact the capacitance value.

The multi-resonant nature obtained also with this family of exemplary embodiments proves unexpected, in as much as it was logical to think that the frequencies higher than the resonant frequency of the first cavity $\mathbf{5}_1$ would not be able to pass through the latter cavity $\mathbf{5}_1$ and reach the adjacent cavities $\mathbf{5}_j$ (with $j \neq 1$).

It will be noted, as illustrated in a nonlimiting manner in FIG. 6, that the device 1 can comprise at least two electrically conductive horizontal partitions $\mathbf{9}_j$, each mounted to be vertically mobile inside one of the cavities $\mathbf{5}_j$, and each forming a bottom wall of one of the compartments $\mathbf{2}_j$. The electrically conductive nature can originate from the material in which each horizontal partition $\mathbf{9}_j$ is produced or from the fact that each horizontal partition $\mathbf{9}_j$ is coated, on its surfaces, with a layer of an electrically conductive material.

This option requires the device 1 to comprise setting means arranged to set the position (here vertical) of each horizontal partition $\mathbf{9}_j$ within its cavity $\mathbf{5}_j$, and therefore its compartment $\mathbf{2}_j$.

It will also be noted that the device 1 can optionally comprise second setting means arranged to set the magnetic permeability of the material filling each compartment $\mathbf{2}_j$. The second setting means can be produced in the form of a magnetic material of adjustable magnetic permeability, such as, for example, a ferromagnetic material or a metamaterial. As a nonlimiting example, the second setting means can be produced in the form of a ferrite whose magnetic permeability changes under the influence of a magnetic field. The reflection band in fact increases with the increase in the magnetic permeability of the material. An adjustable magnetic permeability makes it possible to adjust the inductance.

By virtue of the invention, a high-impedance surface device is made available that is compact because it comprises a reduced number of cavities. There is also made available a high-impedance surface device that is multiband, optionally reconfigurable, and suited to reflection bands that are spectrally wider than in the prior art.

The invention claimed is:

1. A high-impedance surface device, comprising:

a set of at least two separate, substantially cylindrical compartments, having internal surfaces in an electrically conductive material, and each defining, at one end, a single aperture, the apertures of the compartments being oriented on one and the same side, and covered by at least one periodic structure of electrically conductive patterns, each compartment being filled with a dielectric material, each compartment thus covered forming at least one electromagnetic resonator, and each electromagnetic resonator exhibiting a resonant wavelength, wherein:

the at least two compartments are separated from one another by a distance less than the shortest resonant wavelength exhibited by the resonators that they form, at least two respective resonant wavelengths of the electromagnetic resonators formed by the at least two covered compartments are different, and the periodic structure exhibits a spatial period less than half the shortest resonant wavelength.

2. The device as claimed in claim 1, further including a cavity within which each compartment is arranged, at least one vertical partition arranged in the cavity, the vertical partition being electrically conductive, in contact with a bottom wall of the electrically conductive cavity, and delimiting the at least two compartments, and a single periodic structure of electrically conductive patterns covering all the apertures of the compartments ($\mathbf{2}_j$).

3. The device as claimed in claim 2, wherein each vertical partition is moveable in a direction substantially parallel to a plane defined by said bottom wall of said cavity.

4. The device as claimed in claim 2 , wherein each compartment is provided with an auxiliary electrically conductive bottom wall, distinct from said bottom wall of the cavity, and mounted to be vertically moveable in the cavity.

5. The device as claimed in claim 2, further including setting means arranged to set the height of each vertical partition.

6. The device as claimed in claim 2, wherein one of the ends of each vertical partition extends facing one of the electrically conductive patterns, and has a flared section.

7. The device as claimed in claim 1, further including at least two unconnected cavities, each cavity forming one of the compartments.

8. The device as claimed in claim 7, further including at least two horizontal partitions, each horizontal partition being electrically conductive and mounted to be vertically mobile inside one of said cavities, and forming a bottom wall of one of said compartments.

9. The device as claimed in claim 1, wherein each compartment is covered by a single electrically conductive pattern.

10. The device as claimed in claim 1, wherein each periodic structure of electrically conductive patterns is secured to support means.

11. The device as claimed in claim 10, further including first setting means arranged to set the dielectric permittivity of the support means.

12. The device as claimed in claim 1, further including second setting means arranged to set the magnetic permeability of said dielectric material.

13. A satellite positioning signal receiver, comprising:

an electric ground plane;

at least two radiant elements arranged on the ground plane; and at least one high-impedance surface device as claimed in claim 1, arranged on the ground plane between the radiant elements.

14. A method for modifying the impedance over several frequency bands of a high-impedance surface device, comprising:

at least one step of modifying electromagnetic properties of at least one compartment of a high-impedance surface device, the high-impedance surface including:

a set of at least two separate, substantially cylindrical compartments, having internal surfaces in an electrically conductive material, and each defining, at one end, a single aperture, the apertures of the compartments being oriented on one and the same side, and covered by at least one periodic structure of electrically conductive patterns, each compartment being filled with a dielectric material, each compartment thus covered forming at least one electromagnetic resonator, and each electromagnetic resonator exhibiting a resonant wavelength, wherein:

the at least two compartments are separated from one another by a distance less than the shortest resonant wavelength exhibited by the resonators that they form, at least two respective resonant wavelengths of the electromagnetic resonators formed by the at least two covered compartments are different, and the periodic structure exhibits a spatial period less than half the shortest resonant wavelength.

* * * * *